US007503840B2

(12) United States Patent
Iwami et al.

(10) Patent No.: US 7,503,840 B2
(45) Date of Patent: Mar. 17, 2009

(54) COIN ARRANGING/CONVEYING APPARATUS

(75) Inventors: Toyofumi Iwami, Himeji (JP); Mitsuhiko Muranaka, Himeji (JP)

(73) Assignee: Glory, Ltd., Hyogo (JP)

( * ) Notice: Subject to any disclaimer, the term of this patent is extended or adjusted under 35 U.S.C. 154(b) by 401 days.

(21) Appl. No.: 11/535,346

(22) Filed: Sep. 26, 2006

(65) Prior Publication Data

US 2007/0072535 A1 Mar. 29, 2007

(30) Foreign Application Priority Data

Sep. 29, 2005 (JP) ..... 2005-284130

(51) Int. Cl.
*G07D 1/00* (2006.01)

(52) U.S. Cl. ..... 453/56; 453/7; 453/11

(58) Field of Classification Search ..... 453/7, 453/11, 56

See application file for complete search history.

(56) References Cited

U.S. PATENT DOCUMENTS

2005/0042981 A1 * 2/2005 Umeda ..... 453/11

FOREIGN PATENT DOCUMENTS

JP 2002-245506 A 8/2002

OTHER PUBLICATIONS

Patent Abstracts of Japan for JP2002-245506 published Aug. 30, 2002.

* cited by examiner

*Primary Examiner*—Jeffrey A Shapiro
(74) *Attorney, Agent, or Firm*—Darby & Darby P.C.

(57) ABSTRACT

The present invention provides a coin arranging/conveying apparatus that is capable of reliably conveying coins one at a time into a coin passage unit even if there is such a great difference in diameter or thickness of coins. A first gate portion is defined by a separation roller, an arranging/conveying surface of an arranging/conveying belt, and a movable roller. The movable roller faces the underside of the arranging/conveying surface of the arranging/conveying belt. A second gate portion is defined by a coin passage upstream end roller, and the portion of a transfer belt wrapped around the coin passage upstream end roller. Coins are arranged in a single layer in single file by means of the first gate portion, as well as the second gate portion.

3 Claims, 4 Drawing Sheets

COIN ARRANGING/CONVEYING APPARATUS

INCORPORATION BY REFERENCE

The present application claims priority under 35 U.S.C. §119 to Japanese Patent Application No. 2005-284130 filed on Sep. 29, 2005. The content of the application is incorporated herein by reference in its entirety.

FIELD OF THE INVENTION

The present invention relates to a coin arranging/conveying apparatus wherein coins retained in a coin hopper are taken out and conveyed by means of an arranging/conveying belt provided at the bottom of the coin hopper, and the coins are arranged in a single layer in single file by means of a gate portion that is provided with a separation roller facing the arranging/conveying belt.

BACKGROUND OF THE INVENTION

Conventionally, there is a coin arranging/conveying apparatus that requires taking out and conveying coins by means of an arranging/conveying belt provided at the bottom of a coin hopper, controlling the coins into a single-layer state by means of a gate portion having a separation roller that faces the arranging/conveying belt so that the coins are arranged and conveyed one at a time in a single layer in single file (e.g. The coin arranging/conveying apparatus includes a movable guide formed of a plate spring that is disposed below the separation roller and adapted to be pressed against the reverse surface of the arranging/conveying belt, i.e. the surface facing away from the arranging/conveying surface of the belt. The movable roller serves to maintain a specified gate gap between the separation roller and the arranging/conveying surface of the arranging/conveying belt. Should an excessively thick coin enter the aforementioned gap, the movable roller moves downward so as to prevent the coin from being caught in the gap (e. g. See Japanese Laid-open Patent Publication No. 2002-245506 (pages 4-5, FIGS. 1-3).

The coin arranging/conveying apparatus described above is capable of handling objects, such as Japanese coins, that are not significantly different in diameter or thickness, without a problem of coins being caught in the gate portion. However, coins in foreign currencies may present a great difference in size; in some countries, the largest coin may have twice the diameter or thickness of the smallest coin. Should there be such a great difference in diameter or thickness, the coin arranging/conveying apparatus described above may be prone to a problem of coins being caught in the gate portion.

Even if coins become caught in the gate portion, the movable guide moves downward together with the arranging/conveying belt so as to dislodge the coins. Nevertheless, as the arranging/conveying belt is constantly moving while the movable guide does not move in the conveying direction, the arranging/conveying belt is prone to wear due to contact with the movable guide.

Furthermore, even if the coins are dislodged and pass through the gate portion, they will be conveyed towards a coin passage at the downstream side in the state where the coins are in contact with one another. As a result, the coins are prone to become jammed at the stage in which they are conveyed to a transfer belt of the coin passage at the downstream side.

In order to solve the above problems, an object of the present invention is to provide a coin arranging/conveying apparatus that is capable of reliably conveying coins one at a time through a gate portion into a coin passage unit even if there is such a great difference in diameter or thickness of coins.

SUMMARY OF THE INVENTION

A coin arranging/conveying apparatus according to the present invention comprises a coin hopper for holding coins therein, an arranging/conveying belt, a separation roller, a movable roller, a first gate portion, a coin passage unit, and a second gate portion. The arranging/conveying belt is disposed at the bottom of the coin hopper and has an arranging/conveying surface on which coins are arranged and conveyed. The separation roller faces the arranging/conveying surface of the arranging/conveying belt and serves to control coins conveyed by the arranging/conveying belt into a single layer. The movable roller is disposed below the separation roller and faces the underside of the arranging/conveying surface of the arranging/conveying belt. The movable roller is adapted to maintain a given height of a gate gap between the separation roller and the arranging/conveying surface of the arranging/conveying belt and is capable of moving downward should an excessively thick coin or a plurality of coins overlapping each other forming an excessive thickness enter the gate gap. The first gate portion is defined in the coin outputting area of the coin hopper by the separation roller, the portion of the arranging/conveying surface of the arranging/conveying belt that faces the separation roller, and the movable roller, which faces the underside of the arranging/conveying surface of the arranging/conveying belt. The first gate portion serves to arrange coins into a single layer and in single file. The coin passage unit has a coin passage upstream end roller, a transfer belt, and a coin passage bottom plate. The coin passage upstream end roller is disposed downstream from the first gate portion and in proximity to the separation roller so that the cylindrical surface of the coin passage upstream end roller faces the arranging/conveying surface of the arranging/conveying belt, with the distance therebetween being less than the thickness of a coin. The coin passage upstream end roller is capable of moving upward to enable coins to enter between the coin passage upstream end roller and the arranging/conveying surface and adapted to rotate at a speed higher than that of the arranging/conveying belt. The transfer belt is wrapped around the widthwise middle portion of the coin passage upstream end roller, which is located at the upstream end of the conveyance path of the transfer belt. The transfer belt is adapted to rotate at a speed higher than that of the arranging/conveying belt. The coin passage bottom plate extends continuously from the arranging/conveying belt. The second gate portion is defined by the coin passage upstream end roller, the portion of the arranging/conveying surface of the arranging/conveying belt that faces the coin passage upstream end roller, and the portion of the transfer belt that is wrapped around the coin passage upstream end roller.

The first gate portion is defined by the separation roller, the portion of the arranging/conveying surface of the arranging/conveying belt that faces the separation roller, and the movable roller facing the underside of the arranging/conveying surface of the arranging/conveying belt. The second gate portion is defined by the coin passage upstream end roller, the portion of the arranging/conveying surface of the arranging/conveying belt that faces the coin passage upstream end roller, and the portion of the transfer belt wrapped around the coin passage upstream end roller. Coins can be arranged in a single layer in single file by means of the first gate portion, as well as the second gate portion. Therefore, the present invention ensures reliable transportation of coins one at a time through the first gate portion and the second gate portion into the coin passage unit even if there is a great difference in diameter or thickness of coins. Furthermore, at the first gate portion, the movable roller is capable of coming into contact with the underside of the arranging/conveying belt, which faces away from the arranging/conveying surface, so that the movable roller rotates together with the movement of the arranging/conveying surface of the arranging/conveying belt. With the configuration as above, the contact area of the movable roller with the arranging/conveying surface is minimized so that both are less prone to wear.

According to another feature of the present invention, wherein the movable roller, which is adapted to move downward should an excessively thick coin or a plurality of coins overlapping each other forming an excessive thickness enter the first gate portion, is attached to a first arm that is capable of tilting around a first supporting shaft; a conveyance width control member for reducing the width of the passage for conveying coins to the second gate portion is provided at one of the widthwise sides of the portion of the arranging/conveying belt that extends from the first gate portion into the second gate portion; and the aforementioned conveyance width control member is attached to a second arm adapted to tilt around a second supporting shaft in conjunction with the tilting motion of the first arm so that the conveyance width control member descends together with the descent of the movable roller.

The invention facilitates transportation of coins one at a time to the second gate portion, because the width of the passage in which coins are conveyed to the second gate portion is reduced by the conveyance width control member, which is provided along a side edge of the portion of the arranging/conveying belt from the first gate portion into the second gate portion.

According to yet another feature of the present invention, wherein a first pulley and a second pulley disposed coaxially with the first pulley are disposed above the upstream area of the coin passage bottom plate of the coin passage unit; the transfer belt comprises a first transfer belt member and a second transfer belt member, the first transfer belt member being wrapped around the coin passage upstream end roller, which faces the arranging/conveying surface of the arranging/conveying belt, and the first pulley disposed above the coin passage bottom plate, and the second transfer belt member being wrapped around the second pulley, which is located at the upstream end of the conveyance path of the second transfer belt member; a passage side plate, which serves to, together with the first transfer belt member and the second transfer belt member, convey coins in the state where the rim of the coins is guided by the passage side plate, is provided on the coin passage bottom plate, which extends continuously from the arranging/conveying belt, the passage side plate being provided at the widthwise side of the coin passage bottom plate opposite the conveyance width control member; and the passage side plate has a slanted directing portion and a coin rim control portion, the slanted directing portion being provided at a location corresponding to the first transfer belt member and extending from the upstream end of the coin passage bottom plate in the conveying direction in such a manner as to slant toward the widthwise center of the arranging/conveying belt, and the coin rim control portion being formed as an integral, continuous body with the slanted directing portion and extending along the second transfer belt member.

The invention ensures reliable transportation of coins one at a time into the coin passage unit by means of the first transfer belt member and the second transfer belt member. The coin arranging/conveying apparatus of the present invention also ensures reliable execution of further processing of the coins by enabling each coin to be conveyed in such a state that ensures its rim is pressed against the slanted directing portion and the coin rim control portion of the passage side plate.

DETAILED DESCRIPTION OF THE PREFERRED EMBODIMENTS

A description is given of an embodiment of the present invention hereunder with reference to the accompanying drawings.

Figure 1:
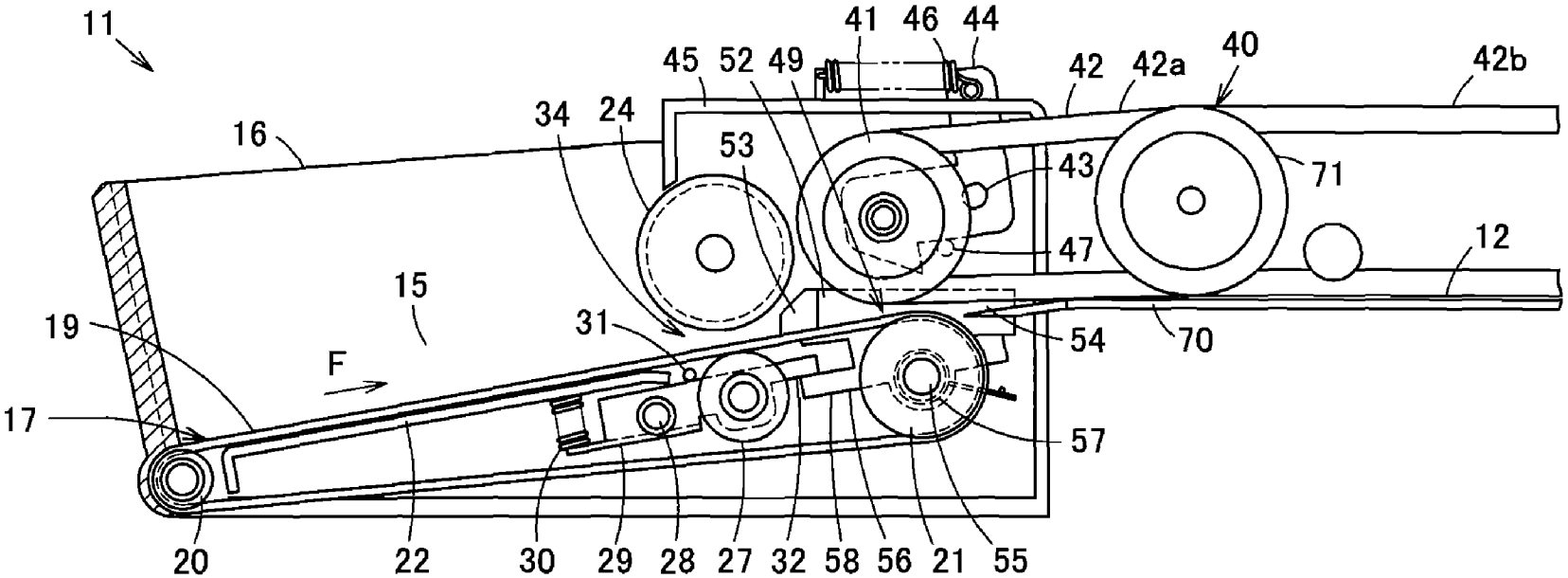
FIG. 1 is a sectional side view of a coin arranging/conveying apparatus according to an embodiment of the present invention viewed from a side.
Figure 2:
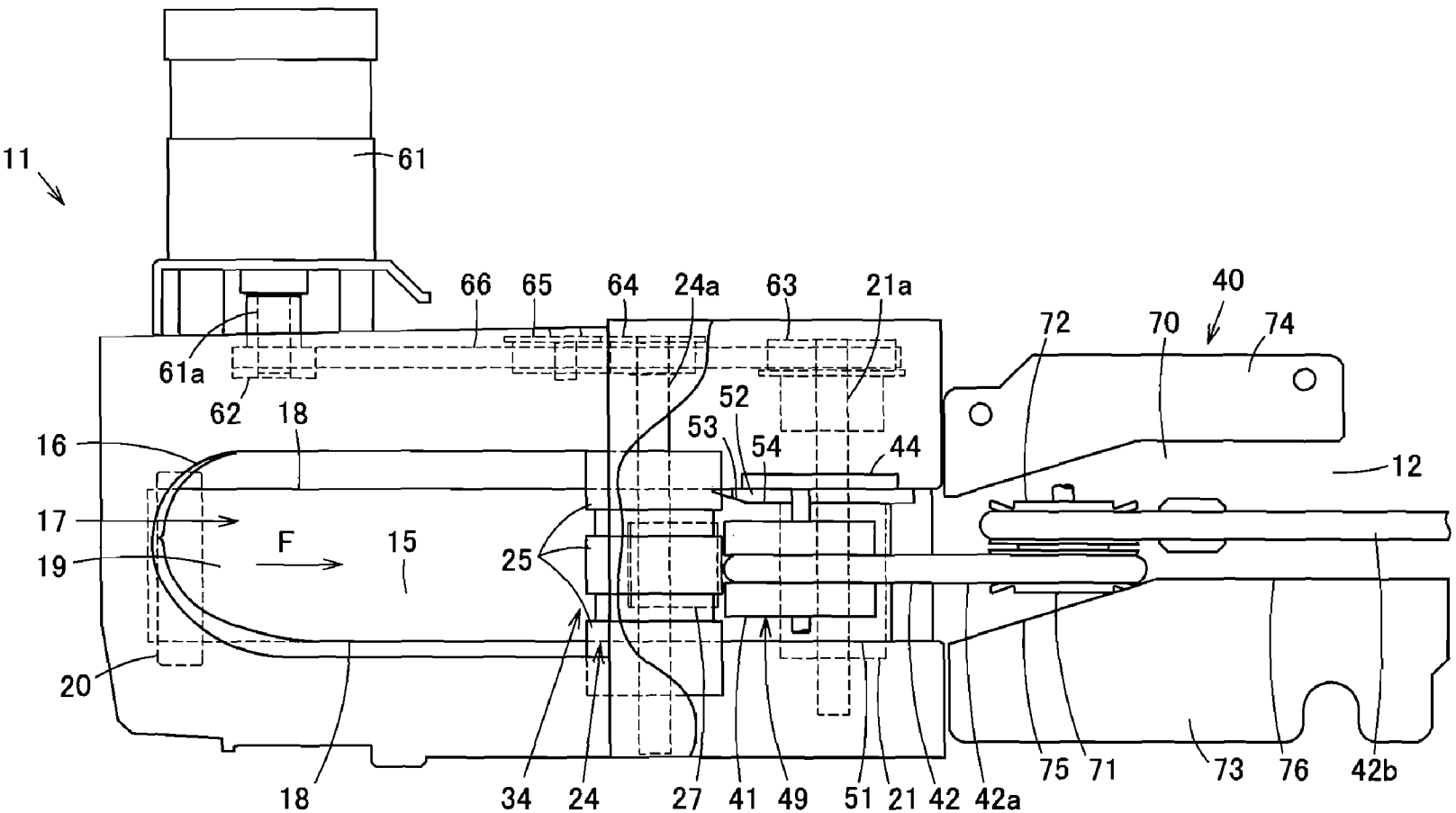
FIG. 2 is a partially-cutaway top view of the aforementioned coin arranging/conveying apparatus.

Referring to FIGS. 1 and 2, a coin arranging/conveying apparatus 11 may be used, for example, in a coin processing apparatus, such as a coin depositing and dispensing machine, to receive a plurality of coins dropped into a receptacle of the coin processing apparatus, separate the received coins, and convey them to a coin passage 12 at the downstream side. While being passed through the coin passage 12, the coins undergo further processing, such as counting at a counting section and sorting at a sorting section.

The coin arranging/conveying apparatus 11 has a coin hopper 16, which forms a holding portion 15 for receiving and holding coins deposited into the coin arranging/conveying apparatus 11. An arranging/conveying belt 17 for bearing coins thereon and conveying them to the coin passage 12 is disposed at the bottom of the holding portion 15 of the coin hopper 16.

The holding portion 15 is formed such that the width of its lower part, which faces the upper surface of the arranging/conveying belt 17, is smaller than the width of the opening at the top of the holding portion 15. The aforementioned width refers to the distance between the inner surface of the two side walls of the holding portion 15, in other words the dimension of the holding portion 15 in the direction intersecting the conveying direction F, in which coins are conveyed by the arranging/conveying belt 17. Two guide portions 18 respectively extend along the two widthwise sides of the lower part of the holding portion 15 and serve to define the width of the conveying path for coins. The distance between the two guide portions 18, i.e. the width of the conveying path for coins, is greater than the greatest diameter of any of the coins to be processed and smaller than the twice the diameter of the smallest coins so that the coins are arranged in single file along the conveying direction F.

The arranging/conveying belt 17 is formed of a flat endless belt that is wider than the width of the holding section 15. The arranging/conveying belt 17 has an arranging/conveying surface 19 that faces the holding section 15 and serves to carry coins thereon. The arranging/conveying belt 17 is wrapped around a roller 20 and a roller 21, which are respectively disposed at the upstream end and the downstream end of the conveying path extending in the conveying direction F. The arranging/conveying belt 17 is positioned so as to slant upward toward the downstream end of the arranging/conveying surface 19, in other words in the conveying direction F.

A guide plate 22 is disposed in a lower part of the holding section 15, at a location below the arranging/conveying surface 19 of the arranging/conveying belt 17, and serves to support and guide the underside of the arranging/conveying surface 19 of the arranging/conveying belt 17, i.e. the surface facing away from the arranging/conveying surface 19.

A separation roller 24 facing the arranging/conveying surface 19 of the arranging/conveying belt 17 is disposed above the conveying path of the holding section 15, at a location corresponding to a coin outputting area of the coin hopper 16. The separation roller 24 is adapted to be rotated in reverse of the direction in which the arranging/conveying surface 19 of the arranging/conveying belt 17 is moving. The separation roller 24 is disposed at a fixed position, at a given distance (hereinafter referred to as the gate gap) from the arranging/conveying surface 19 of the arranging/conveying belt 17 so as to control coins conveyed by the arranging/conveying belt 17 into a single layer. The separation roller 24 has three roller portions 25, which are respectively formed around the two lateral end parts and the middle part of the cylindrical surface of the separation roller 24 and adapted to come into contact with coins.

A movable roller 27 facing the underside of the arranging/conveying surface 19 of the arranging/conveying belt 17 is disposed below the separation roller 24. While the movable roller 27 is disposed at such a position as to maintain the gate gap with a given distance between the separation roller 24 and the arranging/conveying surface 19 of the arranging/conveying belt 17, the movable roller 27 is capable of moving downward should an excessively thick object enter the gate gap. Examples of an excessively thick object mentioned above include a particularly thick coin, e.g. a counterfeit coin, and two coins stacked on top of each other.

The movable roller 27 is rotatably supported at a proximity of one end of a first arm 29, which is capable of tilting around a first supporting shaft 28. A spring 30 is disposed between the underside of the guide plate 22 and the first arm 29 and attached to the other end of the first arm 29. The spring 30 constantly pushes the movable roller 27 upward, in such a direction as to push the movable roller 27 against the arranging/conveying belt 17. The upward movement of the movable roller 27 is restricted by the first arm 29 coming into contact with a stopper 31. A protruding portion 32 is formed at the first mentioned end of by the first arm 29.

When the first arm 29 is in contact with a stopper 31, the movable roller 27 is at its home position, which is selected from two options, i.e. either in contact with the underside of the arranging/conveying surface 19 of the arranging/conveying belt 17 or in the non-contact state. In cases where the regular position of the movable roller 27 is a position at which the movable roller 27 is in the non-contact state, the movable roller 27 comes into contact with the arranging/conveying belt 17 when the arranging/conveying surface 19 of the arranging/conveying belt 17 is lowered by the presence of coins. At that time, should an excessively thick object pass, the movable roller 27 is pushed lower the regular position.

A first gate portion 34 for arranging coins into a single layer in single file is defined in the coin outputting area of the coin hopper 16 by the separation roller 24, the portion of the arranging/conveying surface 19 of the arranging/conveying belt 17 that faces the separation roller 24, and the movable roller 27, which faces the underside of the arranging/conveying surface 19 of the arranging/conveying belt 17.

A coin passage upstream end roller 41 and a transfer belt 42 are disposed downstream from the first gate portion 34 above the arranging/conveying belt 17. The coin passage upstream end roller 41 is a part of a coin passage unit 40, which forms the coin passage 12. The transfer belt 42 is wrapped around the widthwise middle portion of the cylindrical surface of the coin passage upstream end roller 41.

The coin passage upstream end roller 41 is rotatably supported by a shaft that is disposed at an end of an arm 44. The arm 44 is capable of tilting around a supporting shaft 43. A cover 45 covers the space above the coin outputting area of the coin hopper 16. A spring 46 is disposed between and attached to the cover 45 and the other end of the arm 44. The spring 46 constantly applies downward force to the coin passage upstream end roller 41, towards the arranging/conveying surface 19 of the arranging/conveying belt 17. The first mentioned end of the arm 44 is capable of coming into contact with a stopper 47, which prevents the coin passage upstream end roller 41 from moving downward. When the first mentioned end of the arm 44 is in contact with the stopper 47, the cylindrical surface of the coin passage upstream end roller 41 faces the arranging/conveying surface 19 of the arranging/conveying belt 17, with the distance therebetween being less than the thickness of a coin, and the coin passage upstream end roller 41 is capable of moving upward to enable coins to enter between the coin passage upstream end roller 41 and the arranging/conveying surface 19.

The coin passage upstream end roller 41, the portion of the arranging/conveying surface 19 of the arranging/conveying belt 17 that faces the coin passage upstream end roller 41, and the portion of transfer belt 42 wrapped around the coin passage upstream end roller 41 together define a second gate portion 49 for arranging coins into a single layer in single file.

A guide plate member 51 for guiding the rim of coins is disposed at one of the widthwise sides of the portion of the arranging/conveying belt 17 from the first gate portion 34 into the second gate portion 49. The guide plate member 51 is provided so as to extend continuously from the guide portion 18 at that side of the arranging/conveying belt 17. At the other side of the aforementioned portion of the arranging/conveying belt 17, a conveyance width control member 52 for reducing the width of the passage for conveying coins to the second gate portion 49 is provided so as to overhang the side edge of the arranging/conveying surface 19 of the arranging/conveying belt 17. In other words, the conveyance width control member 52 extends further towards the center of the arranging/conveying surface 19 than does the guide portion 18 at that side of the arranging/conveying belt 17. The conveyance width control member 52 has a slanted directing portion 53 and a coin rim control portion 54, which is formed as an integral, continuous body with the slanted directing portion 53. The slanted directing portion 53 extends from the first gate portion 34 towards the second gate portion 49 in such a manner as to slant toward the widthwise center of the arranging/conveying belt 17.

The conveyance width control member 52 is supported by a second arm 56, which is capable of tilting around a second supporting shaft 55. The second supporting shaft 55 also serves as a rotation shaft 21*a* of the aforementioned roller 21. A torsion spring 57 is fitted around the second supporting shaft 55. One end of the torsion spring 57 is engaged with the second arm 56, and the other end of the torsion spring 57 is engaged with the main body of the coin arranging/conveying apparatus 11 so that the torsion spring 57 applies constant force to the second arm 56 in such a direction that the portion of the second arm 56 that faces the first gate portion 34, in other words the portion at which the upstream end of the conveyance width control member 52 is located, is pushed upward. The second arm 56 has a catching portion 58 adapted to catch the protruding portion 32 of the first arm 29. In the state where the catching portion 58 is engaged with the protruding portion 32 of the first arm 29, the engagement with the protruding portion 32 prevents the catching portion 58 from being moved upward by the force applied by the torsion spring 57. When the first arm 29 is in contact with the stopper 31, the stopper 31 also serves as a stopper for the second arm 56.

When the movable roller 27 is at an elevated position, and the catching portion 58 of the second arm 56 is engaged with the first arm 29, which is in contact with the stopper 31, a gap that is narrow enough to prevent entrance of a coin is maintained between the lower end of the conveyance width control member 52 and the arranging/conveying surface 19 of the arranging/conveying belt 17. Should an excessively thick object enter under the separation roller 24 and cause the movable roller 27 to move downward together with the arranging/conveying belt 17, the second arm 56 tilts in conjunction with the tilting motion of the first arm 29, thereby lowering the upstream end of the conveyance width control member 52. In other words, as a result of the downward movement of the arranging/conveying belt 17 below the separation roller 24, the upstream end of the conveyance width control member 52 moves downward so that the gap between the lower end of the conveyance width control member 52 and the arranging/conveying surface 19 of the arranging/conveying belt 17 is ensured to be narrow enough to prevent entrance of a coin.

Figure 3:
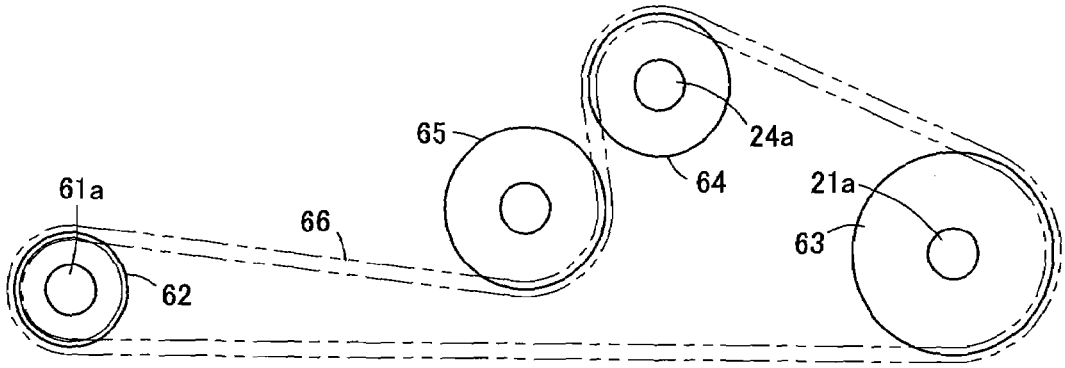
FIG. 3 is a side view of a driving system of the aforementioned coin arranging/conveying apparatus.

As shown in FIGS. 2 and 3, a motor 61 is disposed at the side of the coin hopper 16 that is closer to the conveyance width control member 52. The motor 61 has a driving shaft 61*a* that is provided with a pulley 62. The rotation shaft 21*a* of the roller 21 of the arranging/conveying belt 17 is provided with a pulley 63. A rotation shaft 24*a* of the separation roller 24 of the arranging/conveying belt 17 is provided with a pulley 64. A pulley 65 is provided for applying tension. An endless round belt 66 is wrapped around these pulleys 62,63, 64,65. Therefore, the motor 61 rotating in normal direction turns the arranging/conveying belt 17 so that its arranging/conveying surface 19 moves in the conveying direction F and also rotates the separation roller 24 in the direction opposite the moving direction of the arranging/conveying surface 19 of the arranging/conveying belt 17.

The coin passage unit 40 has a coin passage bottom plate 70 that extends continuously from the arranging/conveying belt 17. Two coaxially arranged pulleys, i.e. a first pulley 71 and a second pulley 72, are rotatably disposed above the upstream area of the coin passage bottom plate 70.

The transfer belt 42 has a first transfer belt member 42*a* and a second transfer belt member 42*b*, each of which is an endless round belt. The first transfer belt member 42*a* is wrapped around the coin passage upstream end roller 41, which faces the arranging/conveying surface 19 of the arranging/conveying belt 17, and the first pulley 71 disposed above the coin passage bottom plate 70. The second transfer belt member 42*b* is wrapped around the second pulley 72, which is located at the upstream end of the conveyance path of the second transfer belt member 42*b*.

Components of the coin passage unit 40, such as the coin passage upstream end roller 41 and the transfer belt 42, are adapted to be rotated by a motor (not shown in the drawings) at a speed higher than rotation speed of the arranging/conveying belt 17.

Passage side plates 73,74, which respectively form the two side plates of the coin passage 12, are provided on the coin passage bottom plate 70, which extends continuously from the arranging/conveying belt 17.

The passage side plate 73 disposed on the coin passage bottom plate 70 extends along one of the widthwise sides of the coin passage bottom plate 70, i.e. the side opposite the conveyance width control member 52. Together with the first transfer belt member 42*a* and the second transfer belt member 42*b*, the passage side plate 73 serves to convey coins in the state where the rim of the coins is guided by the passage side plate 73. To fulfill this function, the passage side plate 73 has a slanted directing portion 75 and a coin rim control portion 76. The slanted directing portion 75 is provided at a location corresponding to the first transfer belt member 42*a* and extends from the upstream end of the coin passage bottom plate 70 in the conveying direction in such a manner as to slant toward the widthwise center of the arranging/conveying belt 17. The coin rim control portion 76 is formed as an integral, continuous body with the slanted directing portion 75 and extends along the second transfer belt member 42*b*.

Figure 4:
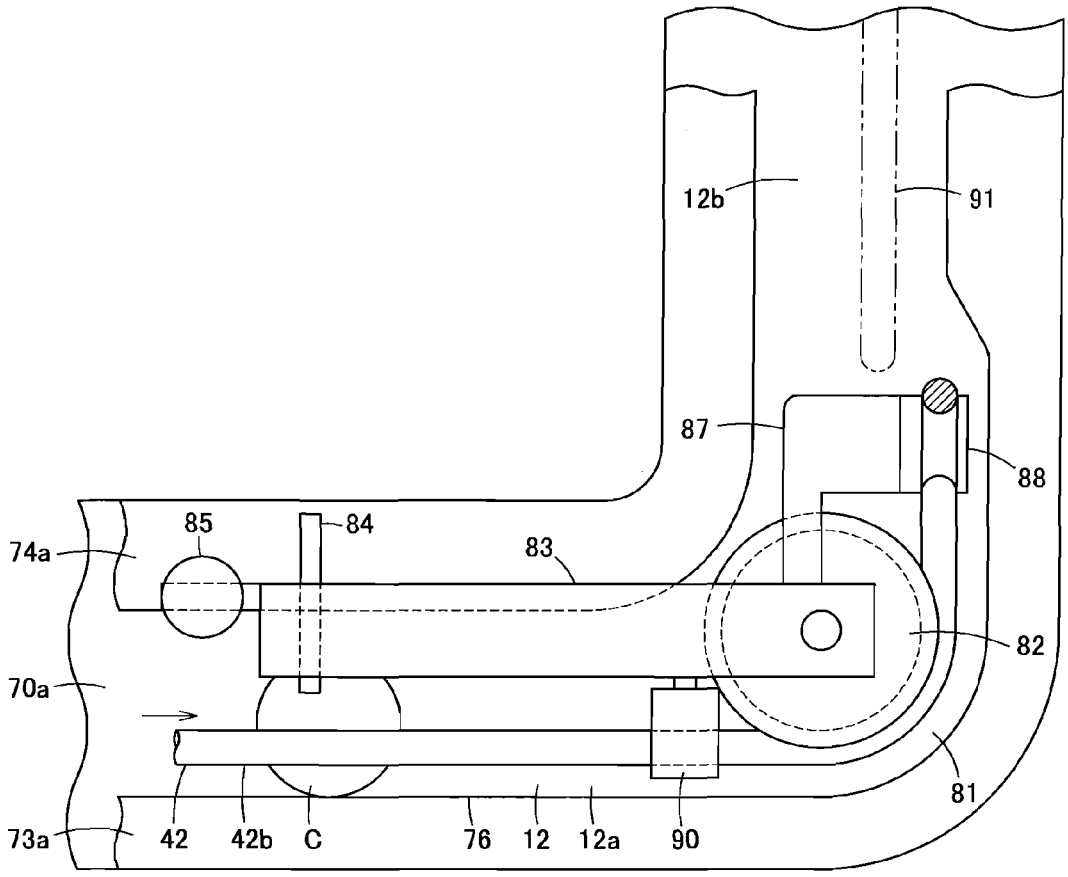
FIG. 4 is a top view of a coin passage unit of the aforementioned coin arranging/conveying apparatus.
Figure 5:
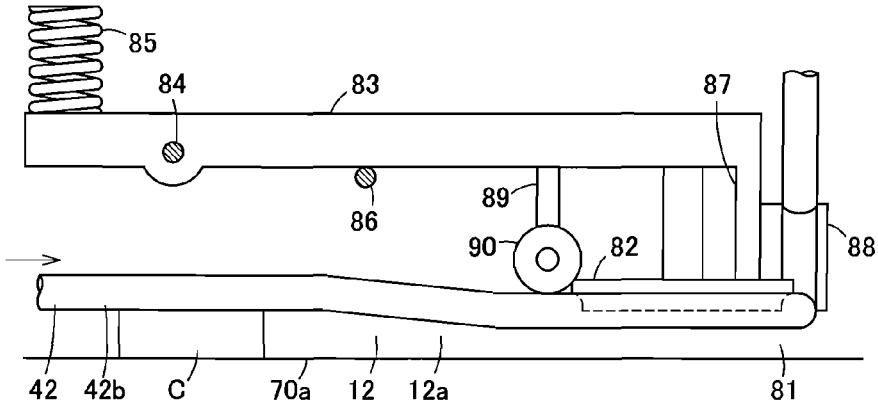
FIG. 5 is a side view of the aforementioned coin passage unit of the coin arranging/conveying apparatus.

As shown in FIGS. 4 and 5, the coin passage 12 includes a coin passage bottom plate 70*a*, a passage side plate 73*a*, and a passage side plate 74*a*, which extend continuously from the coin passage bottom plate 70, the passage side plate 73, and the passage side plate 74, respectively. The coin passage 12 also includes a turnabout portion 81 at which the course of conveying coins turns at nearly a right angle. The portion of the coin passage 12 that is upstream from the turnabout portion 81, i.e. the portion between the arranging/conveying belt 17 and the turnabout portion 81, is a first passage portion 12*a*, and the portion downstream from the turnabout portion 81 is a second passage portion 12*b*. The first passage portion 12*a* serves as an identifying passage section in which respective denominations of coins are identified by means of, for example, an identifying unit. The second passage portion 12*b* serves as a sorting passage section in which coins are sorted, for example, according to results of identification.

The turnabout portion 81 is provided with a turn pulley 82, which is disposed in an approximately horizontal position so as to face the coin passage bottom plate 70. The turn pulley 82 serves to change the course of the second transfer belt member 42*b* from the first passage portion 12*a* to the second passage portion 12*b*. The turn pulley 82 is rotatably supported by a shaft at an end of a support link 83 disposed along the first passage portion 12*a*. The proximity of the other end of the support link 83, i.e. the end corresponding to the upstream end of the first passage portion 12*a*, is supported by a nearly horizontal supporting shaft 84 in such a manner that the support link 83 is capable of tilting vertically. A spring 85 constantly pulls the aforementioned other end of the support link 83 upward so that a downward force is constantly applied to the turn pulley. The downward movement of the turn pulley 82 is restricted by the support link 83 coming into contact with a stopper 86 at a location where the underside of the second transfer belt member 42*b* faces the coin passage bottom plate 70, with the distance therebetween being less than the thickness of a coin.

A lever portion 87 projects from the first mentioned end of the support link 83. A pulley 88 is rotatably supported by a shaft that is attached to the lever portion 87. The pulley 88 serves to turn to the upward direction the course of the second transfer belt member 42*b* that has been directed by the turn pulley 82 to the second passage portion 12*b*. After being directed upward by the pulley 88, the second transfer belt member 42*b* passes over the coin passage 12 and returns to the second pulley 72.

An arm portion 89 projecting downward is provided near the first mentioned end of the support link 83, at a location upstream from the turn pulley 82. A guide roller 90 is supported by a nearly horizontal shaft attached to the arm 89. The guide roller 90 is adapted to come into contact with the upper part of the second transfer belt member 42*b* and be thereby rotated.

The second passage portion 12*b* is provided with a conveyor belt 91 for conveying coins received from the second transfer belt member 42*b*.

Next, the functions of the coin arranging/conveying apparatus 11 is explained hereunder.

Referring to FIGS. 1 and 2, coins to be processed are dropped into the holding section 15 of the coin hopper 16. The dropped coins are loaded on the arranging/conveying surface 19 of the arranging/conveying belt 17. Of these coins, those that have fallen onto the arranging/conveying surface 19 of the arranging/conveying belt 17 between the guide portions 18, 18 at the two opposing sides of the coin hopper 16 line up single file in the conveying direction F.

Rotation of the motor 61 in normal direction turns the arranging/conveying belt 17, thereby moving the arranging/conveying surface 19 of the arranging/conveying belt 17 in the conveying direction F, and also rotates the separation roller 24 in the direction opposite the moving direction of the arranging/conveying surface 19 of the arranging/conveying belt 17. As a result of rotation of the aforementioned motor of the coin passage unit 40 that is not shown in the drawings, the first transfer belt 42*a* and the second transfer belt 42*b* of the transfer belt 42 and other related components are rotated at a peripheral speed higher than the peripheral speed of the arranging/conveying belt 17

Together with the arranging/conveying surface 19 of the arranging/conveying belt 17, the coins on the arranging/conveying surface 19 move in the conveying direction F, and only the coins that are in surface contact with the arranging/conveying surface 19 pass in a single layer below the separation roller 24. In other words, the coins on top of those in surface contact with the arranging/conveying surface 19 are pushed back towards the holding section 15 as a result of the oppositely rotating separation roller 24 so that only the coins that are in surface contact with the arranging/conveying surface 19 are permitted to pass in a single layer below the separation roller 24.

Should an excessively thick object, such as a particularly thick coin, examples of which include a counterfeit coin, reach the space under the separation roller 24, the particularly thick coin entering the space below the separation roller 24 applies force against the spring 30 so as to push the arranging/conveying belt 17 downward together with the movable roller 27 disposed under the arranging/conveying belt 17. As a result, the coin is able to pass through without becoming lodged under the separation roller 24.

Another example of an excessively thick object is where two coins with the rear end of one coin overlapping the leading end of the coin immediately upstream therefrom with respect to the conveying direction F reach the space under the separation roller 24 in the state where both coins are in contact with the arranging/conveying belt 17; the two coins enter the space below the separation roller 24 and apply force against the spring 30 so as to push the arranging/conveying belt 17 downward together with the movable roller 27 disposed under the arranging/conveying belt 17. As a result, the separation roller 24, which is rotating in the opposite direction, pushes the coin located at the downstream side off of the surface of the arranging/conveying belt 17 and onto the coin at the upstream side, and subsequently back into the holding section 15. Consequently, the coin that was originally located at the upstream side alone passes first below the separation roller 24.

When the arranging/conveying belt 17 sags downward, the movable roller 27 comes into contact with the underside of the arranging/conveying belt 17, which faces away from the arranging/conveying surface 19, so that the movable roller 27 rotates together with the movement of the arranging/conveying surface 19 of the arranging/conveying belt 17. As the contact area of the movable roller 27 with the arranging/conveying surface 19 is minimized, both are less prone to wear.

With the configuration as above, coins can be arranged into a single layer and in single file by means of the first gate portion 34, which is defined by the separation roller 24, the portion of the arranging/conveying surface 19 of the arranging/conveying belt 17 that faces the separation roller 24, and the movable roller 27, which faces the underside of the arranging/conveying surface 19 of the arranging/conveying belt 17.

Coins are conveyed to the second gate portion 49 along a passage whose width is reduced by the conveyance width control member 52, which is provided along a side edge of the portion of the arranging/conveying belt 17 from the first gate portion 34 into the second gate portion 49. This configuration facilitates transportation of coins one at a time to the second gate portion 49.

As the conveyance width control member 52 is formed such that when the movable roller 27 of the first gate portion 34 is at an elevated position, and the catching portion 58 of the second arm 56 is engaged with the first arm 29, which is in contact with the stopper 31, a gap that is narrow enough to prevent entrance of a coin is maintained between the lower end of the conveyance width control member 52 and the arranging/conveying surface 19 of the arranging/conveying belt 17, the conveyance width control member 52 ensures reliable transportation of coins one at a time to the second gate portion 49. Should an excessively thick object enter under the separation roller 24 and cause the movable roller 27 to move downward together with the arranging/conveying belt 17, the second arm 56 tilts in conjunction with the tilting motion of the first arm 29, thereby lowering the upstream end of the conveyance width control member 52. In other words, as a result of the downward movement of the arranging/conveying belt 17 below the separation roller 24, the upstream end of the conveyance width control member 52 moves downward so that the gap between the lower end of the conveyance width control member 52 and the arranging/conveying surface 19 of the arranging/conveying belt 17 is ensured to be narrow enough to prevent entrance of a coin. Thus, the conveyance width control member 52 ensures reliable transportation of coins one at a time to the second gate portion 49.

Each coin conveyed towards the second gate portion 49 along the passage whose width is reduced by the conveyance width control member 52 enters the space under the coin passage upstream end roller 41 while applying force against the spring 46 so as to push the coin passage upstream end roller 41 upward, and is conveyed forward by the first transfer belt member 42*a* of the transfer belt 42. As the coin passage upstream end roller 41 and the first transfer belt member 42*a* of the transfer belt 42 are rotated at a speed higher than the turning speed of the arranging/conveying belt 17, even if the coins reach the coin passage upstream end roller 41 in a continuous line along the conveying direction F, the coins can be conveyed to the coin passage 12 one at a time, spaced apart from one another.

With the configuration as above, coins can be arranged in a single layer in single file by means of the second gate portion 49, which is defined by the coin passage upstream end roller 41, the portion of the arranging/conveying surface 19 of the arranging/conveying belt 17 that faces the coin passage upstream end roller 41, and the portion of transfer belt 42 wrapped around the coin passage upstream end roller 41.

As described above, the first gate portion 34 is defined by the separation roller 24, the portion of the arranging/conveying surface 19 of the arranging/conveying belt 17 that faces the separation roller 24, and the movable roller 27, which faces the underside of the arranging/conveying surface 19 of the arranging/conveying belt 17. The second gate portion 49 is defined by the coin passage upstream end roller 41, the portion of the arranging/conveying surface 19 of the arranging/conveying belt 17 that faces the coin passage upstream end roller 41, and the portion of the transfer belt 42 wrapped around the coin passage upstream end roller 41. Coins can be arranged in a single layer in single file by means of the first gate portion 34, as well as the second gate portion 49. Therefore, the configuration described above ensures reliable transportation of coins one at a time through the first gate portion 34 and the second gate portion 49 into the coin passage unit 40 even if there is a great difference in diameter or thickness of coins.

After passing through the second gate portion 49, coins are transferred from the arranging/conveying belt 17 onto the coin passage bottom plate 70 so that the first transfer belt member 42*a* of the transfer belt 42 and, subsequently, the second transfer belt member 42*b* of the transfer belt 42 conveys the coins inside the coin passage 12.

The first transfer belt member 42*a*, the second transfer belt member 42*b*, and the passage side plate 73, which is disposed on the coin passage bottom plate 70 and extends along one of the widthwise sides of the coin passage bottom plate 70, i.e. the side opposite the conveyance width control member 52, together serve to convey coins in the state where the rim of the coins is guided by the passage side plate 73. To be more specific, when the coins are conveyed by the first transfer belt member 42*a*, the second transfer belt member 42*b*, and the passage side plate 73, the rim of the coins is guided by means of the slanted directing portion 75 and the coin rim control portion 76 of the passage side plate 73. The slanted directing portion 75 is provided at a location corresponding to the first transfer belt member 42*a* and extends from the upstream end of the coin passage bottom plate 70 in the conveying direction in such a manner as to slant toward the widthwise center of the arranging/conveying belt 17. The coin rim control portion 76 is formed as an integral, continuous body with the slanted directing portion 75 and extends along the second transfer belt member 42*b*. This configuration enables each coin to be conveyed in such a state that ensures its rim is pressed against the slanted directing portion 75 and the coin rim control portion 76 of the passage side plate 73, which is provided at one of the widthwise sides of the coin passage bottom plate 70, and thereby ensures reliable execution of further processing of the coins.

As shown in FIGS. 4 and 5, in the coin passage 12, coins are conveyed in such a state that they are pushed against the coin passage bottom plate 70*a* by means of the second transfer belt member 42*b*; the conveying direction of the coins is changed at the turnabout portion 81 from the first passage portion 12*a* to the second passage portion 12*b* as a result of changing the direction of the second transfer belt member 42*b* by means of the turn pulley 82; and the coins are transferred in the second passage portion 12*b* from the second transfer belt member 42*b* to the conveyor belt 91, which conveys the coins while pushing them against the coin passage bottom plate 70*a*. The coins are conveyed by the second transfer belt member 42*b* and the conveyer belt 91 in the state that the rim of the coins is guided by means of the passage side plate 73.

As the second transfer belt member 42*b* is supported in such a manner that its underside faces the coin passage bottom plate 70*a* with the distance therebetween being less than the thickness of a coin, each portion of the second transfer belt member 42*b* at which a coin is sandwiched between the second transfer belt member 42*b* and the coin passage bottom plate 70*a* is pushed upward to accommodate the thickness of the coin. Immediately before a coin that is being carried by the second transfer belt member 42*b* reaches the turn pulley 82, the second transfer belt member 42*b* pushes the guide roller 90 upward, and the downstream portion of the support link 83 moves upward against the force applied by the spring 85, thereby moving the turn pulley 82 upward. As a result, the coin passes through without coming into contact with the turn pulley 82.

The configuration described above is particularly effective in cases where the coin is an excessively thick coin C. Immediately before an excessively thick coin C carried by the second transfer belt member 42*b* reaches the turn pulley 82, the portion of the second transfer belt member 42*b* that is raised by the excessively thick coin C causes the turn pulley 82 to be moved upward through the guide roller 90 and the support link 83. Therefore, the excessively thick coin C is able to pass through without coming into contact with the turn pulley 82.

As described above, before a coin carried by the second transfer belt member 42*b* reaches the turn pulley 82, the turn pulley 82 can be raised to a sufficient height to accommodate the thickness of the coin. Therefore, the coin arranging/conveying apparatus according to the invention is capable of handling coins of significantly varying thickness, such as coins in foreign currencies.

The movable roller 27 described in the embodiment explained above may be rotated at the same speed as that of the arranging/conveying surface 19 of the arranging/conveying belt 17.

The coin arranging/conveying apparatus 11 is applicable to not only coin processing apparatus for handling monetary coins, such as coin depositing and dispensing machines, coin depositing machines, and coin sorting machines, but also apparatus for handling other types of coins, such as medal processing machines and token processing machines for processing entertainment-use medals or tokens. Therefore, examples of coins to be handled by the coin arranging/conveying apparatus 11 include entertainment-use medals or tokens, in addition to monetary coins.

What is claimed is:

1. A coin arranging/conveying apparatus comprising:

a coin hopper for holding coins therein;

an arranging/conveying belt disposed at the bottom of the coin hopper and has an arranging/conveying surface on which coins are arranged and conveyed;

a separation roller that faces the arranging/conveying surface of the arranging/conveying belt and serves to control coins conveyed by the arranging/conveying belt into a single layer;

a movable roller disposed below the separation roller and facing the underside of the arranging/conveying surface of the arranging/conveying belt so that the movable roller maintains a given height of a gate gap between the separation roller and the arranging/conveying surface of the arranging/conveying belt while being capable of moving downward should an excessively thick coin or a plurality of coins overlapping each other forming an excessive thickness enter the gate gap;

a first gate portion that is provided in the coin outputting area of the coin hopper and serves to arrange coins into a single layer and in single file, the first gate portion being defined by:

the separation roller, the portion of the arranging/conveying surface of the arranging/conveying belt that faces the separation roller, and the movable roller, which faces an underside of the arranging/conveying surface of the arranging/conveying belt;

a coin passage unit including:

a coin passage upstream end roller adapted to rotate at a speed higher than that of the arranging/conveying belt and disposed downstream from the first gate portion and in proximity to the separation roller so that the cylindrical surface of the coin passage upstream end roller faces the arranging/conveying surface of the arranging/conveying belt, with the distance therebetween being less than the thickness of a coin, and that the coin passage upstream end roller is capable of moving upward to enable coins to enter between the coin passage upstream end roller and the arranging/conveying surface, a transfer belt wrapped around the widthwise middle portion of the coin passage upstream end roller, which is located at the upstream end of the conveyance path of the transfer belt, the transfer belt being adapted to rotate at a speed higher than that of the arranging/conveying belt, and a coin passage bottom plate extending continuously from the arranging/conveying belt; and a second gate portion that serves to arrange coins into a single layer and in single file and is defined by:

the coin passage upstream end roller, the portion of the arranging/conveying surface of the arranging/conveying belt that faces the coin passage upstream end roller, and the portion of the transfer belt that is wrapped around the coin passage upstream end roller.

2. A coin arranging/conveying apparatus as claimed in claim 1, wherein:

the movable roller, which is adapted to move downward should an excessively thick coin or a plurality of coins overlapping each other forming an excessive thickness enter the first gate portion, is attached to a first arm that is capable of tilting around a first supporting shaft;

a conveyance width control member for reducing the width of a passage for conveying coins to the second gate portion is provided at one of the widthwise sides of the portion of the arranging/conveying belt that extends from the first gate portion into the second gate portion; and the conveyance width control member is attached to a second arm adapted to tilt around a second supporting shaft in conjunction with tilting motion of the first arm so that the conveyance width control member descends together with the descent of the movable roller.

3. A coin arranging/conveying apparatus as claimed in claim 2, wherein:

a first pulley and a second pulley disposed coaxially with the first pulley are disposed above the upstream area of the coin passage bottom plate of the coin passage unit;

the transfer belt comprises:

a first transfer belt member wrapped around the coin passage upstream end roller, which faces the arranging/conveying surface of the arranging/conveying belt, and the first pulley disposed above the coin passage bottom plate, and a second transfer belt member wrapped around the second pulley, which is located at the upstream end of the conveyance path of the second transfer belt member;

a passage side plate, which serves to, together with the first transfer belt member and the second transfer belt member, convey coins in the state where the rim of the coins is guided by the passage side plate, is provided on the coin passage bottom plate, which extends continuously from the arranging/conveying belt, the passage side plate being provided at the widthwise side of the coin passage bottom plate opposite the conveyance width control member; and the passage side plate comprises:

a slanted directing portion provided at a location corresponding to the first transfer belt member and extending from the upstream end of the coin passage bottom plate in the conveying direction in such a manner as to slant toward the widthwise center of the arranging/conveying belt, and a coin rim control portion that is formed as an integral, continuous body with the slanted directing portion and extends along the second transfer belt member.

* * * * *